US006709221B2

(12) United States Patent
Roura Adell et al.

(10) Patent No.: US 6,709,221 B2
(45) Date of Patent: Mar. 23, 2004

(54) GRIPPING MEANS FOR HANDLING BLOOD PLASMA CONTAINERS

(75) Inventors: Sergi Roura Adell, Barcelona (ES); Juan Antonio Dux-Santoy Roldan, Barcelona (ES)

(73) Assignee: Probitas Pharma, S.A., Barcelona (ES)

( * ) Notice: Subject to any disclaimer, the term of this patent is extended or adjusted under 35 U.S.C. 154(b) by 0 days.

(21) Appl. No.: 10/389,340

(22) Filed: Mar. 14, 2003

(65) Prior Publication Data

US 2003/0185658 A1 Oct. 2, 2003

(30) Foreign Application Priority Data

Mar. 26, 2002 (ES) ..... 200200718

(51) Int. Cl.[7] ..... B65G 21/02
(52) U.S. Cl. ..... 414/412; 141/329; 222/83
(58) Field of Search ..... 414/412; 141/65, 141/66, 329, 330; 222/5, 80, 83, 83.5

(56) References Cited

U.S. PATENT DOCUMENTS

| | | | | | |
|---|---|---|---|---|---|
| 4,934,055 | A | * | 6/1990 | Chambers | 141/330 |
| 5,114,043 | A | * | 5/1992 | Collins, Jr. | 141/65 |
| 5,163,585 | A | * | 11/1992 | Campbell | 141/329 |
| 5,265,762 | A | * | 11/1993 | Campbell et al. | 414/412 |
| 5,358,376 | A | * | 10/1994 | van den Top | 414/412 |
| 5,743,313 | A | * | 4/1998 | Josefsson | 141/330 |

* cited by examiner

*Primary Examiner*—James R. Bidwell
(74) *Attorney, Agent, or Firm*—Darby & Darby

(57) ABSTRACT

The gripping device comprises in a single retaining frame a plurality of gripper units for gripping the bottles to be emptied, each of which units comprises, mating with the lateral profile of a bottle, a fixed member and a movable member, capable of fitting round a part of the outer surface of the bottle to be emptied, each of the gripper units having associated with it a device for piercing the bottle, equipped with a piercing member for the introduction of an expulsion gas and drainage of the contents of the bottle, and also an optical sensor for checking the presence of the bottle and checking whether there are contents therein.

3 Claims, 4 Drawing Sheets

GRIPPING MEANS FOR HANDLING BLOOD PLASMA CONTAINERS

The present invention relates to a gripping means for handling blood plasma containers, intended to operate in association with robotized mechanisms for handling plasma containers, especially at their exit from machines intended for the automatic emptying of said bottles.

The gripping means of the present invention is intended to collaborate essentially in the operations of picking up bottles, emptying plasma and discharging the empty bottles, comprising a multiple mounting so that the displacement members of the robot can hold the gripping means and so that the gripping means is capable of handling a plurality of bottles simultaneously in order to empty them.

In a preferred version, the gripping means of the present invention has a frame with a plurality of gripper units, for example three, for holding bottles, each of which units comprises a mechanical gripper device consisting of two units, a movable unit and another, fixed unit, the movable unit being actuated by means of an actuating device, for example a pneumatic cylinder and piston assembly, which can effect the displacement of the movable part of the gripping means in order to hold the bottle between said movable part and a fixed part. The composition of the plurality of units, for example three, arranged in the same single frame will be identical, having the same gripper members in all cases and being associated with members for piercing the plasma bottles and injecting air or non-contaminating gas (for example $N_2$) into the bottles, for which purpose each of the units has a second pneumatic cylinder with a needle for piercing and injection of air which is connected to means for receiving air at low pressure for its injection into the bottle.

The gripping means of the present invention will therefore exhibit, in operation, a first step of gripping the bottles as the movable members of each unit of the gripping means advances, pressing the bottles against the fixed receiving parts, and then proceeding with the perforation of the bottles, thereby permitting the introduction of air or another gas to facilitate their complete emptying and drainage.

All this is controlled from a centralized control assembly.

Each of the gripper units will be associated with a fibre-optic sensor intended to check the presence or absence of the bottles and whether the plasma remains inside the bottles after the emptying step.

The members of the gripping means will be constructed entirely of materials resistant to corrosion and oxidation, such as anodized aluminium and stainless steel, or titanium alloys or polymers and their compounds, ensuring that the materials are resistant to the chemical and physical agents necessary for cleaning and the actual products themselves.

For greater understanding, some drawings of a preferred embodiment of the present invention are appended by way of non-limiting explanatory example.

Figure 1:
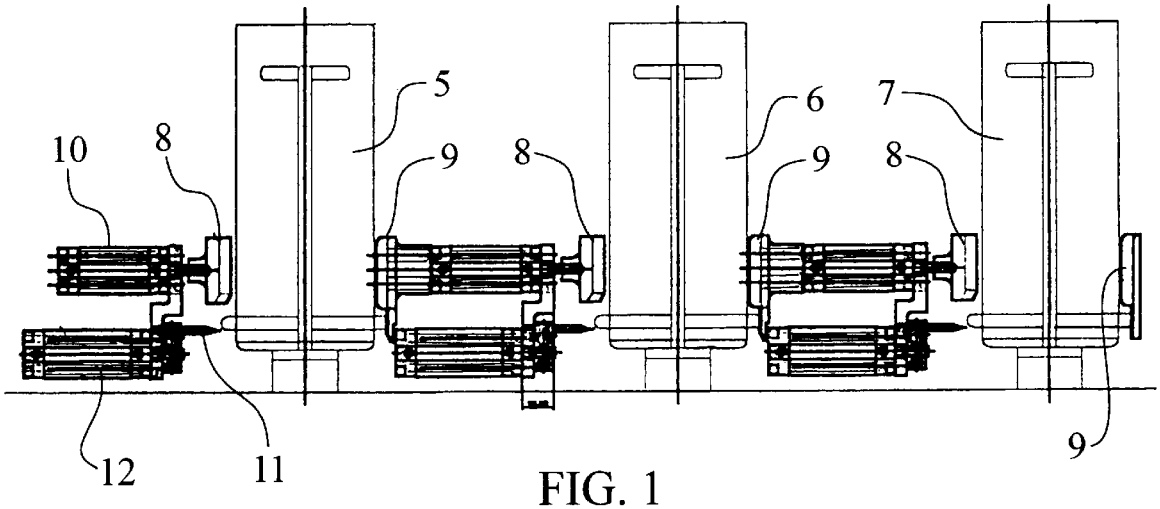
FIGS. 1 and 2 are diagrammatic views respectively in side elevation and in plan of a multiple gripping means for emptying bottles of plasma according to the present invention.
Figure 2:
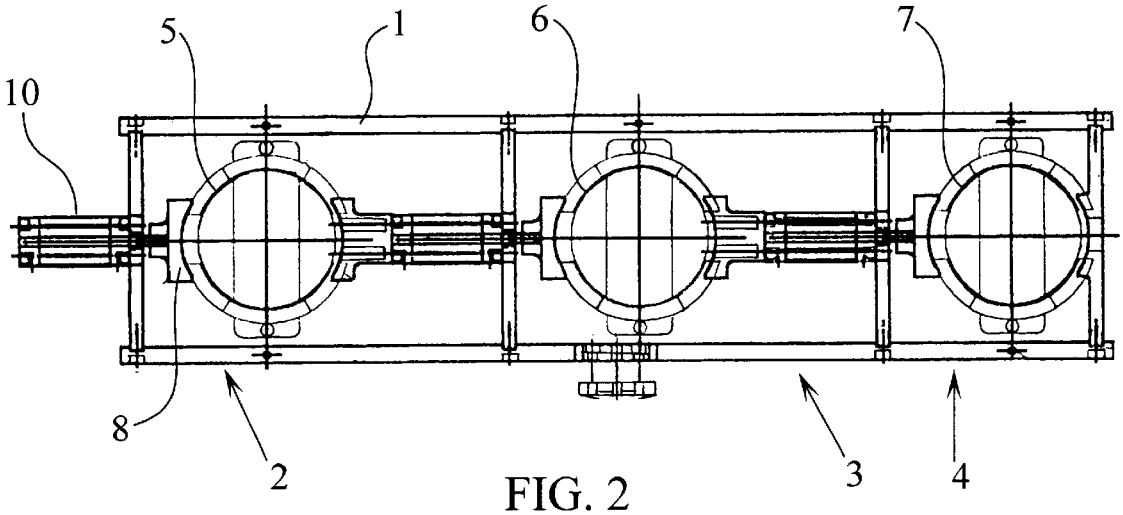

As can be seen in said drawings, the multiple gripping means of the present invention has a frame 1 for receiving the different individual gripper units for holding the bottles and which, in the case illustrated, have been indicated by the numbers 2, 3 and 4, corresponding to a gripping means of the triple type, which is intended for simultaneously handling three bottles of plasma, which have been shown diagrammatically with the numbers 5, 6 and 7. Each of the gripper units of the gripping means comprises a movable member, such as that indicated by the number 8 in FIG. 2 and a fixed member 9. Both members have a concave shape matched to the outer surface of the bottles to be handled. The movable member 8 is actuated by a device 10, preferably a pneumatically operated cylinder and piston mechanism, which allows the corresponding bottle 5 to be held firmly in order to permit the rest of the operations for handling same.

Associated with each of the above-mentioned units is a piercing member or needle 11 intended to penetrate the body of the bottle in order to inject into it a gas at a specific pressure, preferably air, in order to collaborate in the expulsion of the contents of the bottle which is being emptied. Said needle is actuated by a drive mechanism 12, preferably a cylinder and piston device of the pneumatic type.

The units 3 and 4 have a composition identical to that shown for the unit 2, the individual members not having been numbered, for the sake of greater clarity.

Figure 3:
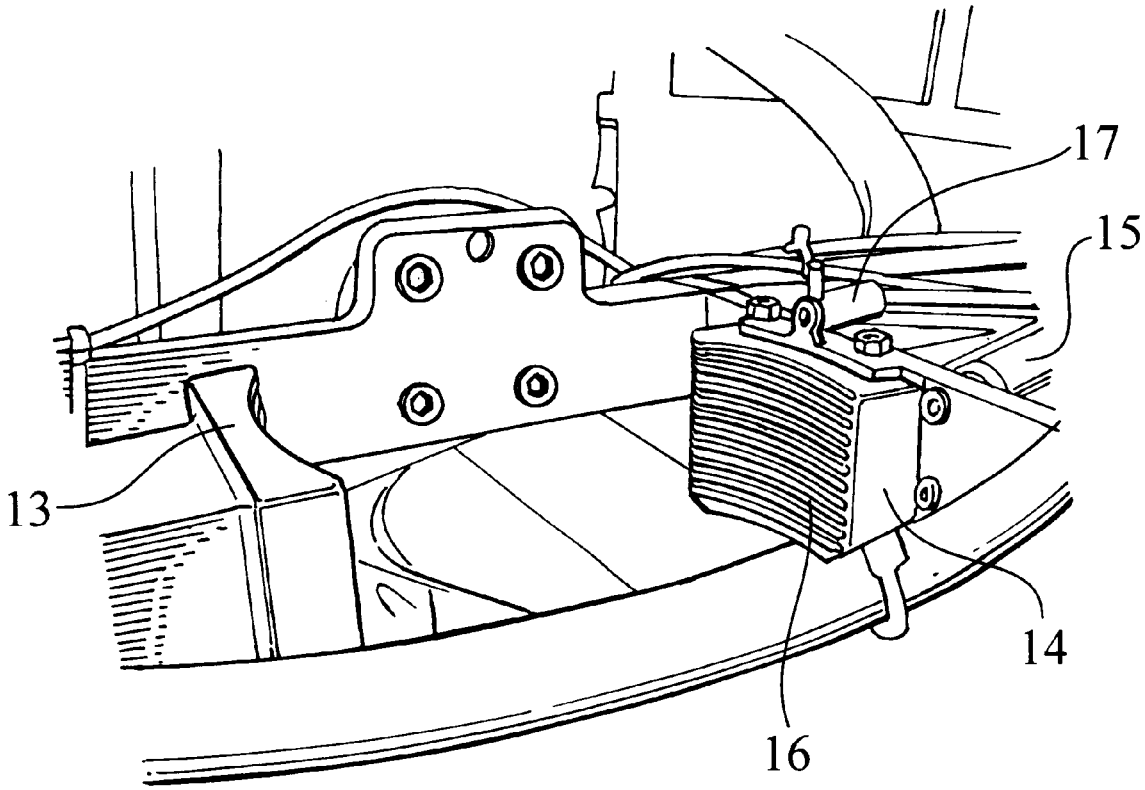
FIG. 3 shows a perspective view of the component members of an individual gripper unit of the gripping means, showing the movable and fixed members for holding a bottle.

FIG. 3 shows in perspective a detail of a gripper unit, made up of the fixed part 13, moving part 14 and cylinder 15 for driving said movable part. Both the fixed part 13 and the movable part 14 have a transversely bowed shape matched to the structure of the bottle to be emptied, preferably further having a relief 16 for improving the holding of the bottle during handling. With the assembly of each gripper unit, a fibre-optic device 17 is provided for checking the presence or absence of the bottles and whether the plasma still remains inside the bottles after the emptying step, sending signals to a control cabin, not shown, which will communicate with the programmable automatic control of the defrosting tunnel and with the programming unit of the robot in order to display any error which has occurred during handling and permitting the manual movability of the automatic device by means of suitable controls.

As will be understood, the present invention will not be limited to a precise number of gripper units of the gripping means nor to other constructional details such as the number and precise shape of the members for holding each bottle and/or the shape of the needle for piercing the bottles.

Figure 5:
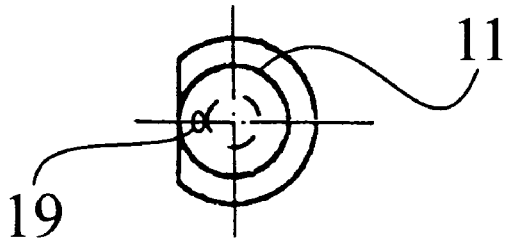
FIG. 5 shows a view from one end of the piercing member used in each of the gripper units of the gripping means.
Figure 6:
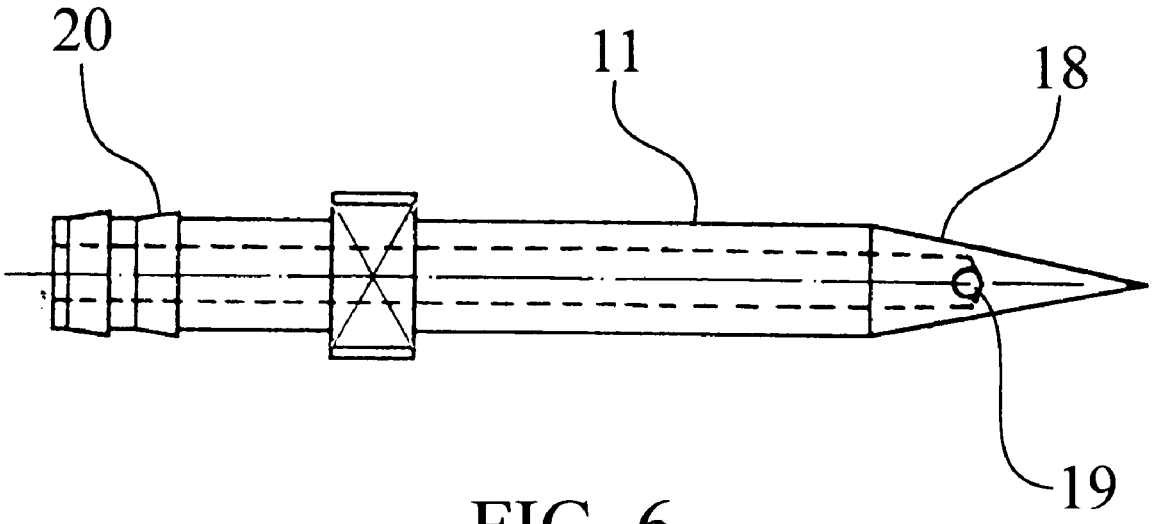
FIG. 6 shows a view in side elevation of the member of FIG. 5.

FIGS. 5 and 6 show details of the piercing member 11, which has a cylindrical body with a pointed end 18, into which one or more apertures 19 open for the emergence of the gas which is conducted through the hollow needle 11, receiving it through the rearward end 20 which is connected to the appropriate means for introducing the propellant gas.

Figure 4:
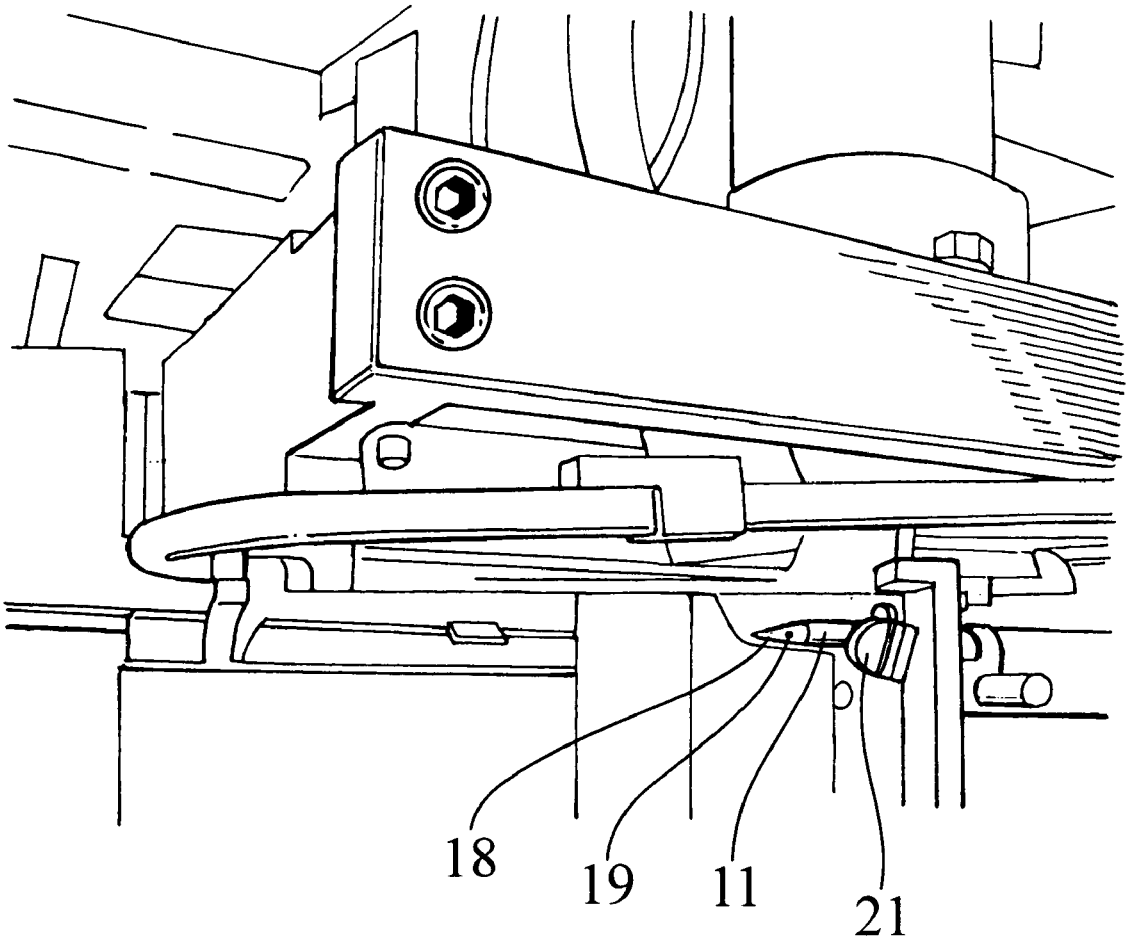
FIG. 4 shows a perspective view of the same unit as in FIG. 3 from the part below that of said figure, showing a needle for piercing a bottle.

The needle or piercing member 11 will be exchangeable after each processing of a batch in order to minimize the risk of contamination, disassembly being carried out manually without the need for special tools, by means of a fixing knob 21 shown in FIG. 4, in which the needle 11 can also be seen.

What is claimed is:

1. A gripping means for handling blood plasma containers, characterized in that it has in a single retaining frame a plurality of gripper units for gripping the bottles to be emptied, each of which units comprises, mating with the lateral profile of a bottle, a fixed member and a movable member, which are capable of fitting round a part of the outer surface of the bottle to be emptied, each of the gripper units having associated with it a piercing device for piercing the bottle and equipped with means for the introduction of a gas for the expulsion of the contents thereof, and also an optical sensor for checking the presence of the bottle and checking whether there are contents therein.

2. A gripping means for handling blood plasma containers according to claim 1, characterized in that the piercing device comprises a hollow needle exchangeable manually by means of a hand knob, and connectable by its rearward end to a source of supply of the expulsion gas and having in its front portion a very pointed zone with outlet apertures for the expulsion gas.

3. A gripping means for handling blood plasma containers according to claim 1, characterized in that both the movable part of the gripper unit and the piercing needle are actuated by respective pneumatic cylinders to effect their advance respectively for holding a bottle and for the piercing and introduction of the expulsion gas and drainage of the contents of the bottle.

* * * * *